US009058004B2

(12) United States Patent
Gomi

(10) Patent No.: US 9,058,004 B2
(45) Date of Patent: Jun. 16, 2015

(54) MANAGEMENT APPARATUS THAT MANAGES A PLURALITY OF IMAGE FORMING APPARATUSES, MANAGEMENT SYSTEM, AND METHOD OF CONTROLLING MANAGEMENT APPARATUS

(71) Applicant: CANON KABUSHIKI KAISHA, Tokyo (JP)

(72) Inventor: Fumiteru Gomi, Abiko (JP)

(73) Assignee: CANON KABUSHIKI KAISHA (JP)

( * ) Notice: Subject to any disclaimer, the term of this patent is extended or adjusted under 35 U.S.C. 154(b) by 195 days.

(21) Appl. No.: 13/628,162

(22) Filed: Sep. 27, 2012

(65) Prior Publication Data

US 2013/0089351 A1 Apr. 11, 2013

(30) Foreign Application Priority Data

Oct. 6, 2011 (JP) ..... 2011-221788

(51) Int. Cl.
*G03G 15/00* (2006.01)

(52) U.S. Cl.
CPC .. *G03G 15/5079* (2013.01); *G03G 2215/00109* (2013.01); *G03G 15/55* (2013.01)

(58) Field of Classification Search
CPC ..... G03G 15/553; G03G 15/55
USPC ..... 399/24, 25, 39, 31, 32, 33, 75, 79, 26
See application file for complete search history.

(56) References Cited

U.S. PATENT DOCUMENTS

2007/0081828 A1* 4/2007 Radulski et al. ..... 399/27

FOREIGN PATENT DOCUMENTS

| | | | |
|---|---|---|---|
| JP | 07-261610 | A | 10/1995 |
| JP | 2003-145890 | A | 5/2003 |
| JP | 2007-033839 | A | 2/2007 |

* cited by examiner

*Primary Examiner* — David Bolduc
*Assistant Examiner* — Barnabas Fekete
(74) *Attorney, Agent, or Firm* — Rossi, Kimms & McDowell LLP

(57) ABSTRACT

A management apparatus that enhances efficiency of maintenance work of a plurality of image forming apparatuses. An apparatus management server is connected to a plurality of image forming apparatuses via a network. Each image forming apparatus includes a storage unit for storing information indicative of wear levels of members for outputting a color image, on a color-by-color basis. The management service acquires the information from each image forming apparatus, and selects an image forming apparatus for outputting an image based on the acquired information such that differences between the wear levels of the members become smaller between the image forming apparatuses.

9 Claims, 6 Drawing Sheets

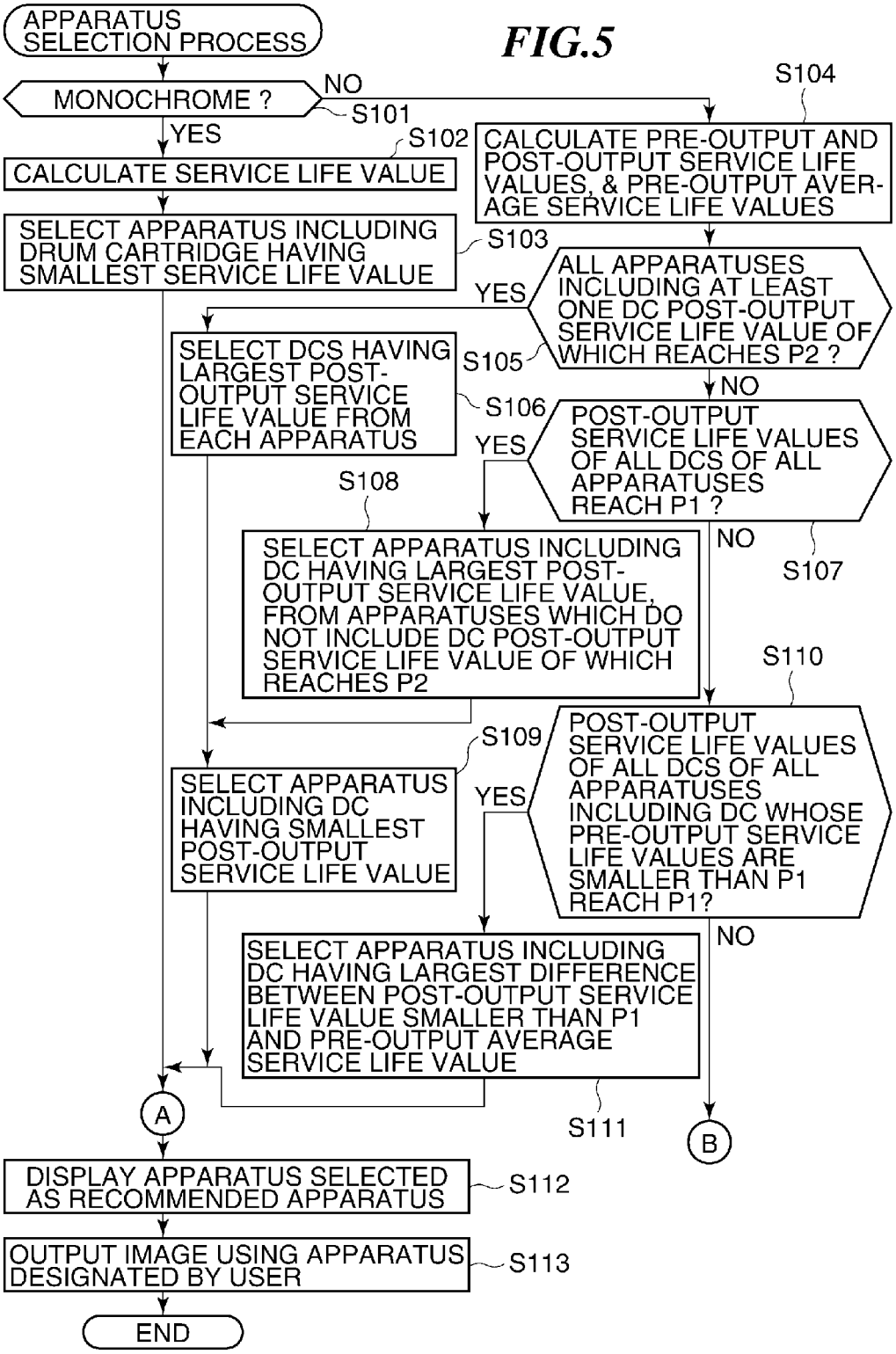
FIG.5
APPARATUS SELECTION PROCESS
MONOCHROME ?
NO
S101
YES
S102
CALCULATE SERVICE LIFE VALUE
SELECT APPARATUS INCLUDING DRUM CARTRIDGE HAVING SMALLEST SERVICE LIFE VALUE
S103
S104
CALCULATE PRE-OUTPUT AND POST-OUTPUT SERVICE LIFE VALUES, & PRE-OUTPUT AVERAGE SERVICE LIFE VALUES
ALL APPARATUSES INCLUDING AT LEAST ONE DC POST-OUTPUT SERVICE LIFE VALUE OF WHICH REACHES P2 ?
YES
S105
NO
SELECT DCS HAVING LARGEST POST-OUTPUT SERVICE LIFE VALUE FROM EACH APPARATUS
S106
POST-OUTPUT SERVICE LIFE VALUES OF ALL DCS OF ALL APPARATUSES REACH P1 ?
YES
NO
S107
S108
SELECT APPARATUS INCLUDING DC HAVING LARGEST POST-OUTPUT SERVICE LIFE VALUE, FROM APPARATUSES WHICH DO NOT INCLUDE DC POST-OUTPUT SERVICE LIFE VALUE OF WHICH REACHES P2
S110
S109
SELECT APPARATUS INCLUDING DC HAVING SMALLEST POST-OUTPUT SERVICE LIFE VALUE
POST-OUTPUT SERVICE LIFE VALUES OF ALL DCS OF ALL APPARATUSES INCLUDING DC WHOSE PRE-OUTPUT SERVICE LIFE VALUES ARE SMALLER THAN P1 REACH P1?
YES
NO
SELECT APPARATUS INCLUDING DC HAVING LARGEST DIFFERENCE BETWEEN POST-OUTPUT SERVICE LIFE VALUE SMALLER THAN P1 AND PRE-OUTPUT AVERAGE SERVICE LIFE VALUE
S111
A
B
DISPLAY APPARATUS SELECTED AS RECOMMENDED APPARATUS
S112
OUTPUT IMAGE USING APPARATUS DESIGNATED BY USER
S113
END

MANAGEMENT APPARATUS THAT MANAGES A PLURALITY OF IMAGE FORMING APPARATUSES, MANAGEMENT SYSTEM, AND METHOD OF CONTROLLING MANAGEMENT APPARATUS

BACKGROUND OF THE INVENTION

1. Field of the Invention

The present invention relates to a management apparatus, a management system, and a method of controlling the management apparatus, and more particularly to a management apparatus that controls a plurality of image forming apparatuses, a management system including the management apparatus, and a method of controlling the management apparatus.

2. Description of the Related Art

In many offices, a plurality of image forming apparatuses are used at the same time. In such a case, in general, a user identifies an image forming apparatus to be used for printing by a terminal unit that issues an image output command, such as a PC (personal computer).

Further, as for service lives of wear-prone components of an image forming apparatus, the number of rotations of drums and the number of sheets subjected to image formation, for example, are stored in a memory of the apparatus, and when such a number reaches a predetermined value, a warning message notifying a timing for replacing a part associated with the number is displayed on an operation screen. Further, there have been proposed contrivances for reducing maintenance costs concerning replacement of a plurality of wear-prone components (see e.g. Japanese Patent Laid-Open Publication No. 2003-145890 and Japanese Patent Laid-Open Publication No. 2007-33839).

On the other hand, to cope with a case where a plurality of image forming apparatuses are installed, there has been proposed a technique for reducing maintenance work by a system that monitors the frequency of use of each image forming apparatus, and causes an image forming apparatus used less frequently to be selectively operated based on results of the monitoring (see e.g. Japanese Patent Laid-Open Publication No. H07-261610).

Specifically, when the expiration of the service life of each of wear-prone components occurs in each of the image forming apparatuses at infrequent but random intervals, a serviceman has to be frequently called for maintenance work, which is inefficient.

Further, in an environment in which a plurality of image forming apparatuses are installed, when a large number of the same images are to be output at a time by the image forming apparatuses, the quality of the image, such as the hues, sometimes differs between the image forming apparatuses. This causes inconveniences when the user demands the strict identity of each image.

In general, in the image forming apparatus, a high-pressure application member or the like is degraded by a long-term use, and resistance thereof varies. Therefore, the image forming apparatus is designed with an effort to keep the voltage or electric current constant throughout the long-term use, so as to preserve the function of an image forming operation at a level equal to its initial level.

However, in a case where the usage history is not equal between the image forming apparatuses, even when high-pressure settings are provided in the respective apparatuses so as to control the images to be equal between the apparatuses, it is difficult to cause the apparatuses to form images which perfectly match each other, particularly in hues.

For example, in an electrophotographic method, even if a primary transfer device is used for performing constant current control, the device has its voltage value changed from an initial voltage value after a long-term use, so that fine transferability is varied. This causes a change in dot reproduction, which sometimes results in a subtle change in the hues of output images.

Further, the amount of laser beam is adjusted in order to compensate for the degradation of drum characteristics, including lowering of sensitivity caused by a long-term use. It is expected that this results in a change in a fine latent image, causing a change in dot reproduction, which results in a change in the hues and the image properties.

Therefore, it is necessary to cause the respective image forming apparatuses to match in the usage history to the utmost, which means that the usage histories of units provided for respective colors match between the image forming apparatuses.

However, in the aforementioned technique proposed in Japanese Patent Laid-Open Publication No. H07-261610, the frequency of use cannot be adjusted on a color-by-color basis, and hence it is impossible to cope with a case where the image forming apparatuses are capable of performing full-color printing e.g. by a tandem method. This is because the use conditions vary with each device and units associated with each color, due to the use of a monochrome mode. Note that the above-mentioned term "each device" is intended to mean an electrostatic charger, a drum, a cleaner, a developing device, and a transfer device. Further, the above-mentioned term "units" is intended to mean a combination of part or all of the electrostatic charger, the drum, the cleaner, the developing device, and the transfer device.

Further, in Japanese Patent Laid-Open Publication No. H07-261610, a state sometimes occurs in which the image forming apparatuses temporarily cannot output any images since the system is configured such that wear-prone components of all the image forming apparatuses can be replaced at a time.

SUMMARY OF THE INVENTION

The present invention provides a management apparatus that enhances efficiency of maintenance work of a plurality of image forming apparatuses, a management system including the management apparatus, and a method of controlling the management apparatus.

In a first aspect of the present invention, there is provided a management apparatus that is connected to a plurality of image forming apparatuses, each of which includes a storage unit for storing information indicative of wear levels of members for outputting a color image, on a color-by-color basis, via a network, comprising:

an acquisition unit configured to acquire the information from each of the plurality of image forming apparatuses, and a selection unit configured to select an image forming apparatus for outputting an image, based on the information acquired by the acquisition unit, such that differences between the wear levels become smaller between the plurality of image forming apparatuses.

In a second aspect of the present invention, there is provided a management system comprising a plurality of image forming apparatuses, each of which includes a storage unit configured to store information indicative of wear levels of members for outputting a color image, on a color-by-color basis, and a management apparatus connected to the plurality of image forming apparatuses via a network, and including an acquisition unit configured to acquire the information from each of the plurality of image forming apparatuses, and a selection unit configured to select an image forming apparatus for outputting an image, based on the information acquired by the acquisition unit, such that differences between the wear levels become smaller between the plurality of image forming apparatuses.

In a third aspect of the present invention, there is provided a method of controlling a management apparatus that is connected to a plurality of image forming apparatuses, each of which includes a storage unit for storing information indicative of wear levels of members for outputting a color image, on a color-by-color basis, via a network, comprising acquiring the information from each of the plurality of image forming apparatuses, and selecting an image forming apparatus for outputting an image, based on the acquired information, such that differences between the wear levels become smaller between the plurality of image forming apparatuses.

According to the present invention, it is possible to enhance efficiency of maintenance work of a plurality of image forming apparatuses.

Further features of the present invention will become apparent from the following description of exemplary embodiments with reference to the attached drawings.

BRIEF DESCRIPTION OF THE DRAWINGS

FIG. 5 is a flowchart of an apparatus selection process which is executed by an apparatus management server when output of an image is instructed.

DESCRIPTION OF THE EMBODIMENTS

Figure 1:
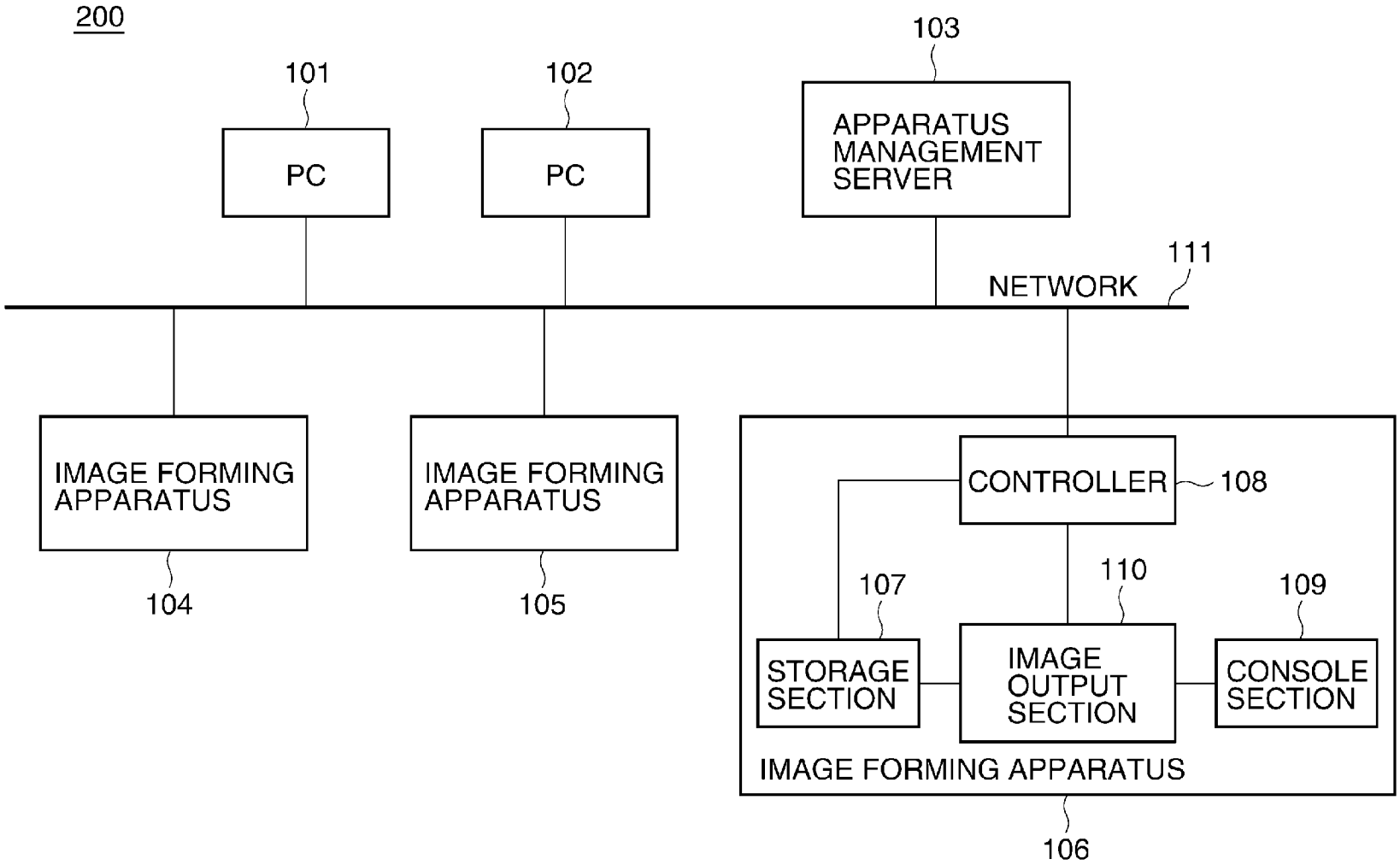
FIG. 1 is a schematic block diagram of an image forming system according to an embodiment of the present invention.

The present invention will now be described in detail below with reference to the accompanying drawings showing embodiments thereof.

Components denoted by the same reference numeral in figures have the same configuration or function, and redundant description thereof is omitted as deemed appropriate.

FIG. 1 is a schematic block diagram of an image forming system 200 according to an embodiment of the present invention.

As shown in FIG. 1, the image forming system 200 (management system) comprises a plurality of (two in FIG. 1) personal computers 101 and 102, an apparatus management server 103 (management apparatus), and a plurality of (three in FIG. 1) image forming apparatuses 104, 105 and 106, which are connected to each other via a network 111.

The personal computers 101 and 102 (host apparatuses) are terminals via which users instruct the image forming apparatuses 104, 105 and 106 to execute printout.

The image forming apparatuses 104, 105 and 106 form images on recording materials, such as paper. In the present embodiment, they are configured to be capable of performing full-color printing by forming four colors of images.

The image forming apparatuses 104, 105 and 106 each have the same configuration. Next, the configuration will be described using the image forming apparatus 106.

The image forming apparatus 106 comprises a controller 108, a storage section 107, an image output section 110, and a console section 109.

The controller 108 comprises a CPU and a RAM, and controls the image forming apparatus 106. The storage section 107, which stores usage history information, described hereinafter, is a nonvolatile storage device, such as a hard disk drive.

The console section 109 for being operated by a user or for displaying information to the user. The user is capable of instructing execution of printout using this console section 109 in place of the personal computers 101 and 102.

The apparatus management server 103 determines which image forming apparatus to be used to output an image when the user executes image output, and causes information for designating the image forming apparatus which should output the image to be displayed on the personal computers 101, 102, and the console section 109.

In the following description, the "apparatus" refers to the image forming apparatus.

Figure 2:
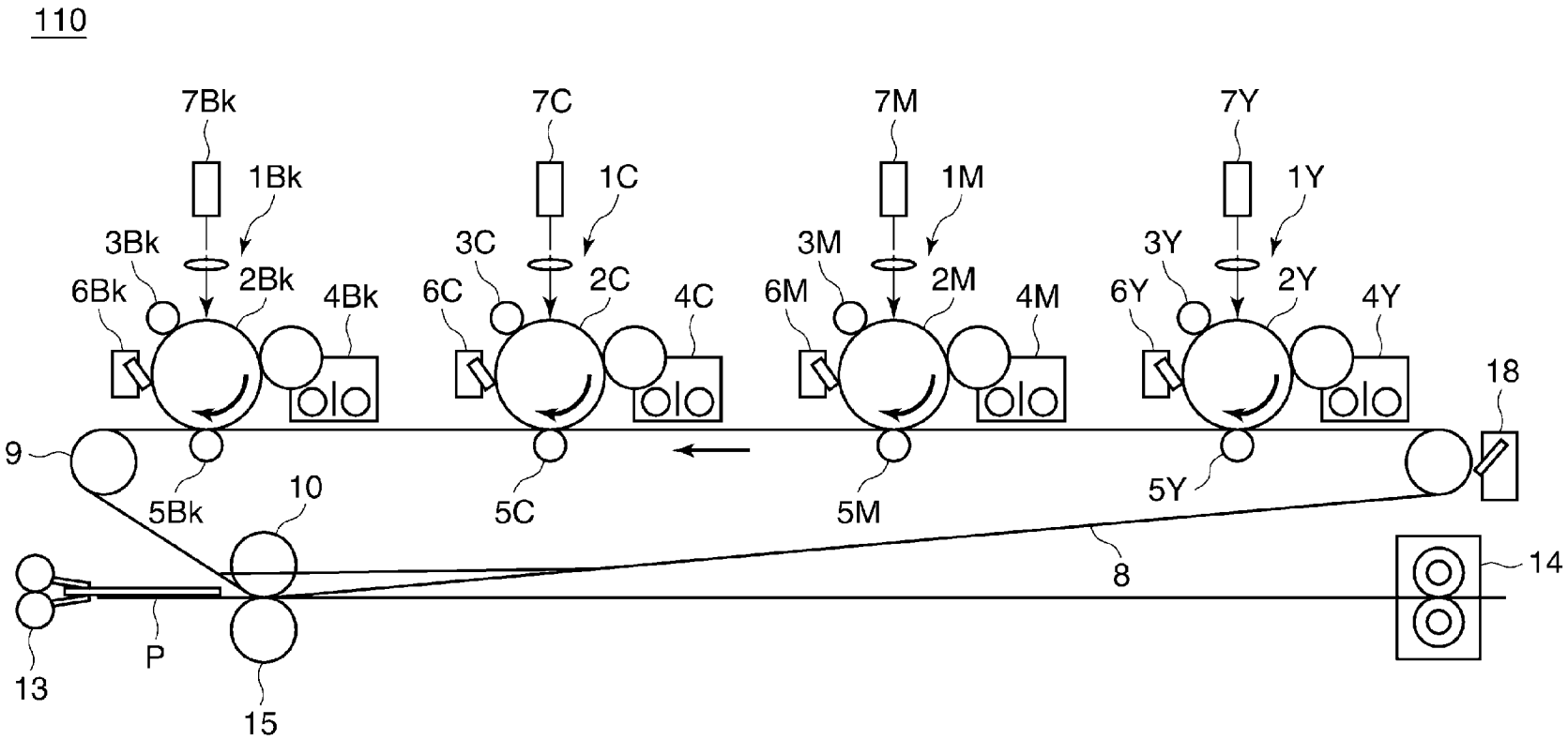
FIG. 2 is a schematic diagram of an image output section of the image forming system appearing in FIG. 1.

FIG. 2 shows the arrangement of the image output section 110 appearing in FIG. 1.

Referring to FIG. 2, the image output section 110 employs an electrophotographic method, and includes four image forming sections 1Y, 1M, 1C and 1Bk provided in a manner associated with four colors of yellow (Y), magenta (M), cyan (C) and black (Bk).

The image output section 110 is capable of forming four color-based full-color images on recording materials (recording sheets, plastic films, and fabric sheets, hereafter referred to as "recording sheets") using the above four image forming sections 1Y, 1M, 1C and 1Bk according to image signals from the controller 108.

Note that in the following description, components commonly provided for the above-described four image forming sections 1Y, 1M, 1C and 1Bk are denoted by the same reference numerals having the suffixes Y, M, C, and Bk added thereto. The suffixes Y, M, C, and Bk added to the reference numerals to represent that the components are provided for the respective different colors are omitted unless it is required to indicate colors for distinction from other components, and the description is given collectively for components associated with respective different colors.

The image output section 110 transfers a toner image, which is formed on a hollow cylindrical photosensitive member as an image bearing member, i.e. a photosensitive drum 2, in each image forming section 1, onto an intermediate transfer belt 8 as an intermediate transfer member. Then, the image output section 110 transfers the toner image formed on the intermediate transfer belt 8 onto a recording sheet P to thereby form a recorded image.

The hollow cylindrical photosensitive member as an image bearing member, i.e. the photosensitive drum 2 is disposed in the image forming section 1. The photosensitive drum 2 is driven for rotation in a direction indicated by an arrow A appearing in FIG. 2.

Around the photosensitive drum 2, there are arranged an electrostatic charging roller 3, a developing device 4, a primary transfer roller 5, and a cleaner 6. Further, an exposure device 7 is disposed above the photosensitive drum 2.

Further, the intermediate transfer belt 8 is disposed in a manner opposed to the photosensitive drum 2 of each image forming section 1. The intermediate transfer belt 8 is stretched around a driving roller 9, a secondary transfer opposed roller 10, and so forth, and is circularly moved in a direction indicated by an arrow in FIG. 2 by a driving force transmitted to the driving roller 9.

The intermediate transfer belt 8 is brought into contact with the photosensitive drum 2 at a location where the primary transfer roller 5 and the photosensitive drum 2 are opposed to each other, whereby a primary transfer section is formed.

Further, a secondary transfer roller 15 is disposed at a location opposed to the secondary transfer opposed roller 10 via the intermediate transfer belt 8.

The secondary transfer roller 15 is brought into contact with the intermediate transfer belt 8 at the location opposed to the secondary transfer opposed roller 10, whereby a secondary transfer section is formed.

The image output section 110 according to the present embodiment is equipped with a full-color image forming mode which is capable of forming a full-color image by using all the image forming sections 1Y, 1M, 1C and 1Bk, and a monochrome image forming mode which forms a monochrome image by using only the image forming section 1Bk.

First, a description will be given of an image forming operation in the full-color image forming mode. When the image forming operation is started, the surfaces of the photosensitive drums 2Y, 2M, 2C, and 2Bk rotating in the respective image forming sections 1Y, 1M, 1C, and 1Bk are uniformly charged by the electrostatic charging rollers 3Y, 3M, 3C, and 3Bk. At this time, a charge bias is applied to the electrostatic charging rollers 3Y, 3M, 3C, and 3Bk from a charge bias power supply.

Then, laser beams are emitted from the exposure devices 7Y, 7M, 7C, and 7Bk according to image signals of color components associated with the respective image forming sections. This causes the photosensitive drums 2Y, 2M, 2C, and 2Bk to be exposed according to image information of associated ones of the color components, whereby electrostatic latent images are formed on the respective photosensitive drums according to the image signals.

The electrostatic latent images formed on the respective photosensitive drums 2Y, 2M, 2C, and 2Bk are developed as toner images by toners contained in the respective developing devices 4Y, 4M, 4C, and 4Bk. The present embodiment employs a reversal development method as a development method whereby the toners from the developing devices 4 adhere to bright potential portions of the respective photosensitive drums 2.

The toner images formed on the respective photosensitive drums 2Y, 2M, 2C, and 2Bk are sequentially transferred onto the intermediate transfer belt 8 by the primary transfer section in a superimposed manner.

At this time, primary transfer bias opposite in polarity to the normal charging polarity of toners is applied to the primary transfer rollers 5Y, 5M, 5C, and 5Bk. Thus, a multi-toner image having the toner images of the four colors superimposed one upon another is formed on the intermediate transfer belt 8. Note that toners remaining on the surfaces of the photosensitive drums 2Y, 2M, 2C, and 2Bk after the primary transfer are collected by the cleaners 6Y, 6M, 6C, and 6Bk, respectively.

On the other hand, a recording sheet P contained in a recording material-containing cassette (not shown) is conveyed to the secondary transfer section by a feed roller pair 13 and the like in timing synchronous with movement of the toner image formed on the intermediate transfer belt 8.

The multi-toner image formed on the intermediate transfer belt 8 is transferred onto the recording sheet P by the secondary transfer section. At this time, secondary transfer bias opposite in polarity to the normal charging polarity of toners is applied to the secondary transfer roller 15.

Then, the recording sheet P is conveyed to a fixing device 14 e.g. by a transfer member. The toners on the recording sheet P are melted and mixed by being heated and pressurized by the fixing device 14, and are fixed to the recording sheet P, whereby a full-color image is formed.

After that, the recording sheet P is discharged out of the apparatus. Note that secondary transfer residual toners, which remain on the intermediate transfer belt 8 without being transferred onto the recording sheet P by the secondary transfer section, are collected by an intermediate transfer belt cleaner 18.

Next, a description will be given of an image forming operation in the monochrome image forming mode. In the monochrome image forming mode, only the image forming section 1Bk forms a toner image on the photosensitive drum 2Bk. This toner image is primarily transferred onto the intermediate transfer belt 8, and is then secondarily transferred onto the recording sheet P. The toner image forming operation by the image forming section 1Bk, the primary transfer operation, and the secondary transfer operation are the same as those in the above-described full-color image forming mode.

Next, a description will be given of the usage history information stored in the storage section 107.

The items of the usage history information in the present embodiment are indicators indicative of use conditions of wear-prone components, such as the photosensitive drums, the electrostatic charging rollers, the developing devices, and the transfer rollers, with respect to the service lives thereof.

The apparatus management server 103 compares the use conditions of the wear-prone components of the image forming apparatuses using the indicators to thereby cause an image forming apparatus having parts in less degraded states to be preferentially used. Here, a description will be given of the usage history information on the photosensitive drum 2, by way of example.

In general, the service life of the photosensitive drum 2 can be defined as time over which it is used until the film thickness of the photosensitive drum 2 is reduced by the abrasion effect of a photosensitive drum-cleaning blade, and finally a required film thickness is lost to cause a fogged image due to a charge failure.

As an example of a factor that makes it possible to predict reduction of the film thickness, there may be mentioned, firstly, the number of rotations of the photosensitive drum 2. Even when the number of rotations of the photosensitive drum 2 is the same, however, the amount of reduction of the film thickness becomes larger when the photosensitive drum 2 rotates in a state in which electrostatic charge is being applied thereto. This is because it is presumed that resin in the surface layer of the photosensitive drum 2 is degraded by discharge of the electrostatic charging roller. From this, it can be said that the film thickness of the photosensitive drum 2 depends on a time period over which charging high voltage is being applied to the electrostatic charging roller.

Further, it is known that the abrasion property of the photosensitive drum-cleaning blade as well is changed by the amount of developer that remains after transfer of the toner image and reaches the photosensitive drum-cleaning blade, and the abrasion by the photosensitive drum-cleaning blade is more promoted as the amount of such developer is larger. This is because the developer acts as an abrasive.

Figure 3:
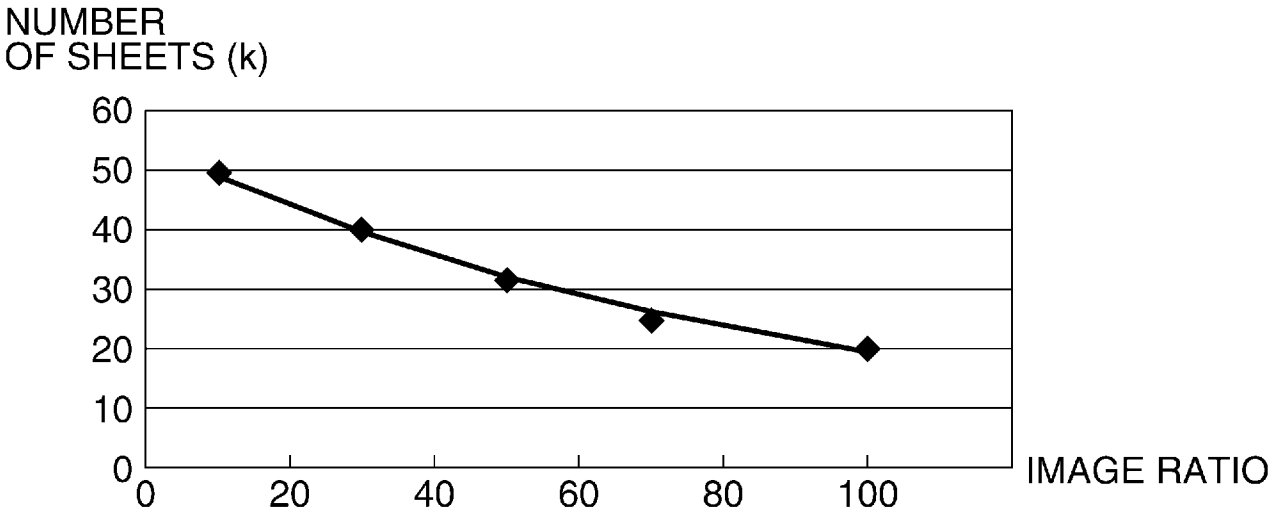
FIG. 3 is a graph of the service life of a photosensitive drum of a drum cartridge appearing in FIG. 2.

FIG. 3 is a view of the service life of the photosensitive drum 2 of a drum cartridge appearing in FIG. 2.

In FIG. 3, the horizontal axis represents an image ratio, and the vertical axis represents the number of the recording sheets (in units of k(1000)). Further, the above-mentioned drum cartridge indicates a unit having the electrostatic charging roller 3, the photosensitive drum 2, and the cleaner 6 integrally formed with each other.

More specifically, FIG. 3 shows the number of the recording sheets on which images are formed before the photosensitive drum 2 reaches its service life, when image forming operations are repeatedly carried out at a fixed image ratio.

It is understood from FIG. 3 that when the image ratio is 10%, the service life of the photosensitive drum 2 expires when image formation is performed on 50 k recording sheets, and becomes shorter as the image ratio becomes higher. Therefore, in the present embodiment, a service life value L of the photosensitive drum 2 is defined based on the approximate curve of this data by the following equation (1):

$$L=C/C1\times(54e-0.01D) \quad (1)$$

In the equation (1), C1 represents a total charging time period in a case where the feed roller 13 is caused to feed 50 k recording sheets by intermittently feeding them one by one, and C represents a total charging time period. D represents an average image ratio in the past sheet feeding operations. Note that the above-mentioned "intermittently feeding sheets one by one" refers to an image forming operation generally performed by designating a value of 1, i.e. one recording sheet. Further, e represents an exponential. Furthermore, the image ratio is a value obtained by dividing an integrated value of count values obtained by counting dots printed by image signals, by the number of recording sheets fed for image formation.

Time information indicating the count value of laser-on time is stored as information corresponding to the amount of printing of images, in the storage section 107 of the drum cartridge. Each of the plurality of image forming apparatuses is provided with a storage unit that stores information for obtaining the wear level of each of members for forming color images, on a color-by-color basis.

Figure 4:
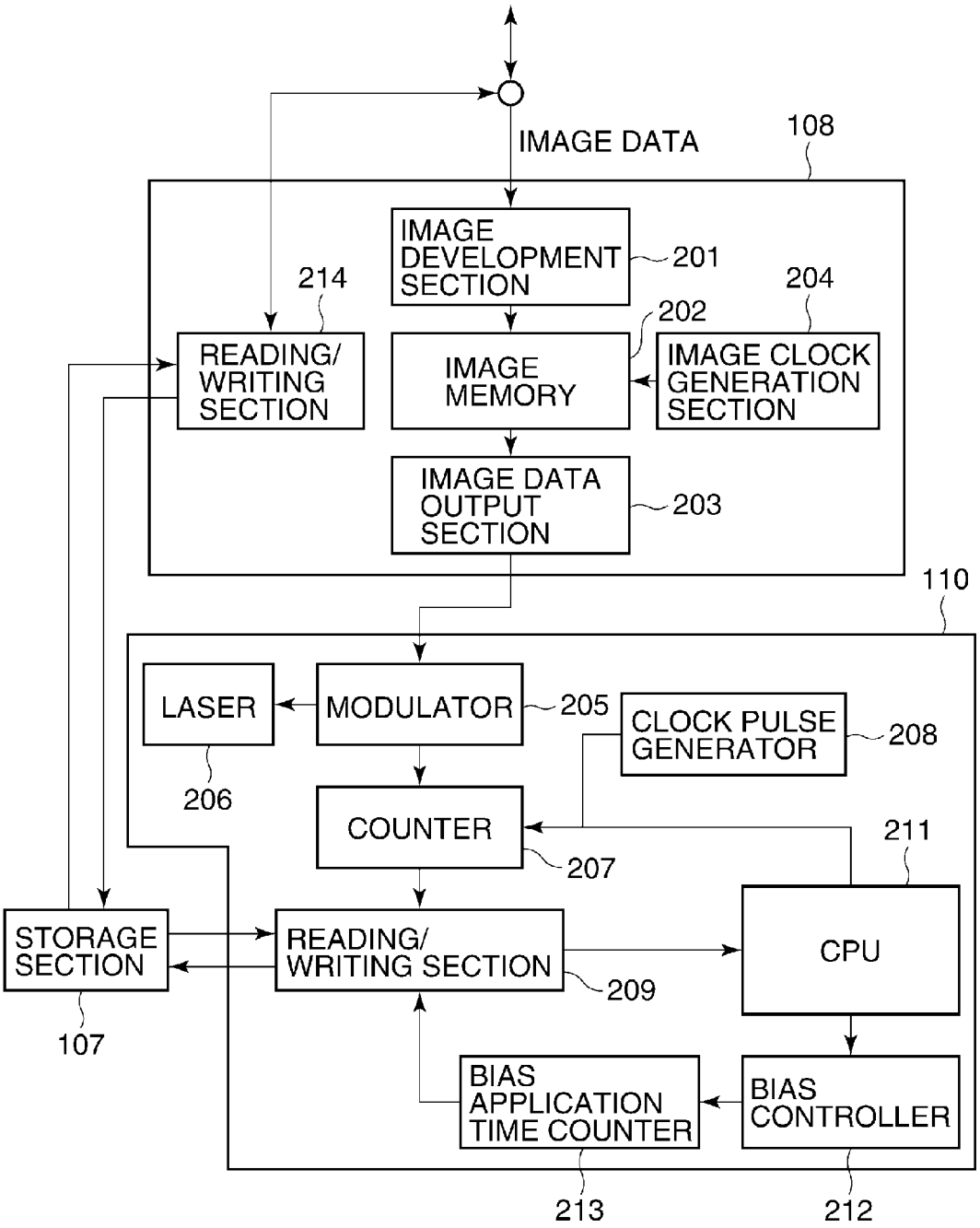
FIG. 4 is a block diagram useful in explaining a laser exposure output control mechanism of the image forming apparatus appearing in FIG. 1.

FIG. 4 is a block diagram useful in explaining a laser exposure output control mechanism of the image forming apparatus 106 appearing in FIG. 1.

Referring to FIG. 4, image data received from the outside or read from the storage section 107 via a reading/writing section 214 is input to the controller 108, and is developed into dot data by an image development section 201. The developed image data is stored in an image memory 202 once, and is then transmitted to the image output section 110 as an image signal, which is a serial signal, by an image data output section 203. A clock is supplied to the image memory 202 by an image clock generation section 204.

The image signal transmitted to the image output section 110 is modulated by a modulator 205 into a laser emission signal for turning on and off a laser 206 according to the image data. The laser 206 is connected to the modulator 205, and emits a laser beam according to the laser emission signal obtained by the modulation.

Further, a counter 207 is connected to the modulator 205, and the counter 207 measures time during which the modulator 205 outputs the laser emission signal to the laser 206, that is, exposure time over which the photosensitive drum 2 is exposed to a laser beam emitted from the laser 206, to thereby output time information indicative of the measured exposure time.

A clock pulse generator 208, such as a crystal oscillator, is connected to the counter 207. The number of clock pulses counted during a time period over which the laser emission signal is output is used as the time information.

The numbers of clock pulses counted by the counter 207 are added by a reading/writing section 209, and values obtained by addition are sequentially written in the storage section 107. Further, a bias application time counter 213 is connected to the reading/writing section 209, and a bias controller 212 is connected to the bias application time counter 213. The bias controller 212 performs bias control according to an instruction from a CPU 211.

In the present embodiment, laser exposure time is directly counted using the number of clock pulses. In other words, the aforementioned total charging time period is represented by a count value C of clock pulses. Therefore, for example, it is also possible to use, as an image signal, a multi-valued signal which increases light emission time corresponding to a pixel of 1 dot for a high-density portion of an image and reduces the light emission time for an intermediate-density portion of the image.

The average image ratio D and the count value C thus obtained are sent from the storage section 107 to the apparatus management server 103 via the controller 108, whereby the service life value L is calculated.

The above-mentioned equation (1) is extracted e.g. from experimental data and is stored in advance in the apparatus management server 103. However, the equation (1) depends on the kind of the image forming apparatus. Mainly for this reason, the equation for calculating the service life value L is not limited to the equation (1).

Further, as for the method of determining the service life of the photosensitive drum, a method is also well known which determines the service life by applying a predetermined voltage to an electrostatic charging roller and calculating a remaining film thickness of the photosensitive drum based on a detected electric current, as disclosed in Japanese Patent Laid-Open Publication No. H07-168486 and Japanese Patent Laid-Open Publication No. 2002-072778. Therefore, a method can also be envisaged as a variation, which defines the service life value L by multiplying a ratio of a reduced amount of the film thickness of the photosensitive drum to an initial film thickness thereof by the number of recording sheets corresponding to the service life of the photosensitive drum.

As to the other wear-prone components, such as a developing sleeve, the intermediate transfer member, and the transfer rollers, a method is general in which the service life thereof is determined based on the total number of rotations of the photosensitive drum. Although in the present embodiment, a description is given of the service life of the drum cartridge in which the photosensitive drum 2 having the shortest replacement cycle, the electrostatic charging roller 3, and the cleaner 6 are integrally formed with each other, the service life of another component part may be employed.

Next, a description will be given of details of processing for determining an image forming apparatus which is to be recommended for image output, based on the service life value.

Although in the present embodiment, the service life of an average drum cartridge expires when the service life value reaches 50 k, the service lives of all the drum cartridges have a predetermined distribution due to various variations. It is experimentally known that the distribution is in a range of the service life values between 47 k and 53 k, where the service lives of almost all the drum cartridges expire.

Therefore, in view of enhancing the efficiency of maintenance support, which is an object of the present invention, it is impossible to adjust the service life values of all the components of the unit such that the components reach the service lives thereof quite at the same time, and hence it is desirable to adjust the service life values such that they fall within a predetermined range considered to be around the service lives, and replace the components at the same time.

To this end, it is assumed that a target service life value P1 and a target service life value P2 are defined by 45 k and 50 k, respectively, and as for a drum cartridge having a service life value that has reached 45 k, a warning saying that the exhaustion of the service life thereof is imminent is caused to be displayed on the personal computers 101 and 102 or the console section 109 of a corresponding one of the image forming apparatuses. In the following description, the target service life values P1 and P2 are simply referred to as "P1" and "P2".

Further, in the present embodiment, the use of the drum cartridges is guided such that the service life values P of as many a number thereof as possible become close to 50 k at the same time. To this end, after termination of an image output operation, the use of an image forming apparatus having a drum cartridge a service life value L of which exceeds 50 k is permitted as less frequently as possible, but another image forming apparatus having a smaller service life value L is preferentially permitted to be used. This is because if P2 is set to 50 k, even an image forming apparatus in which an image defect starts to be produced at a service life value L of 47 k can maintain the image defect at a slight level. However, P1 and P2 can be changed as desired.

Figure 6:
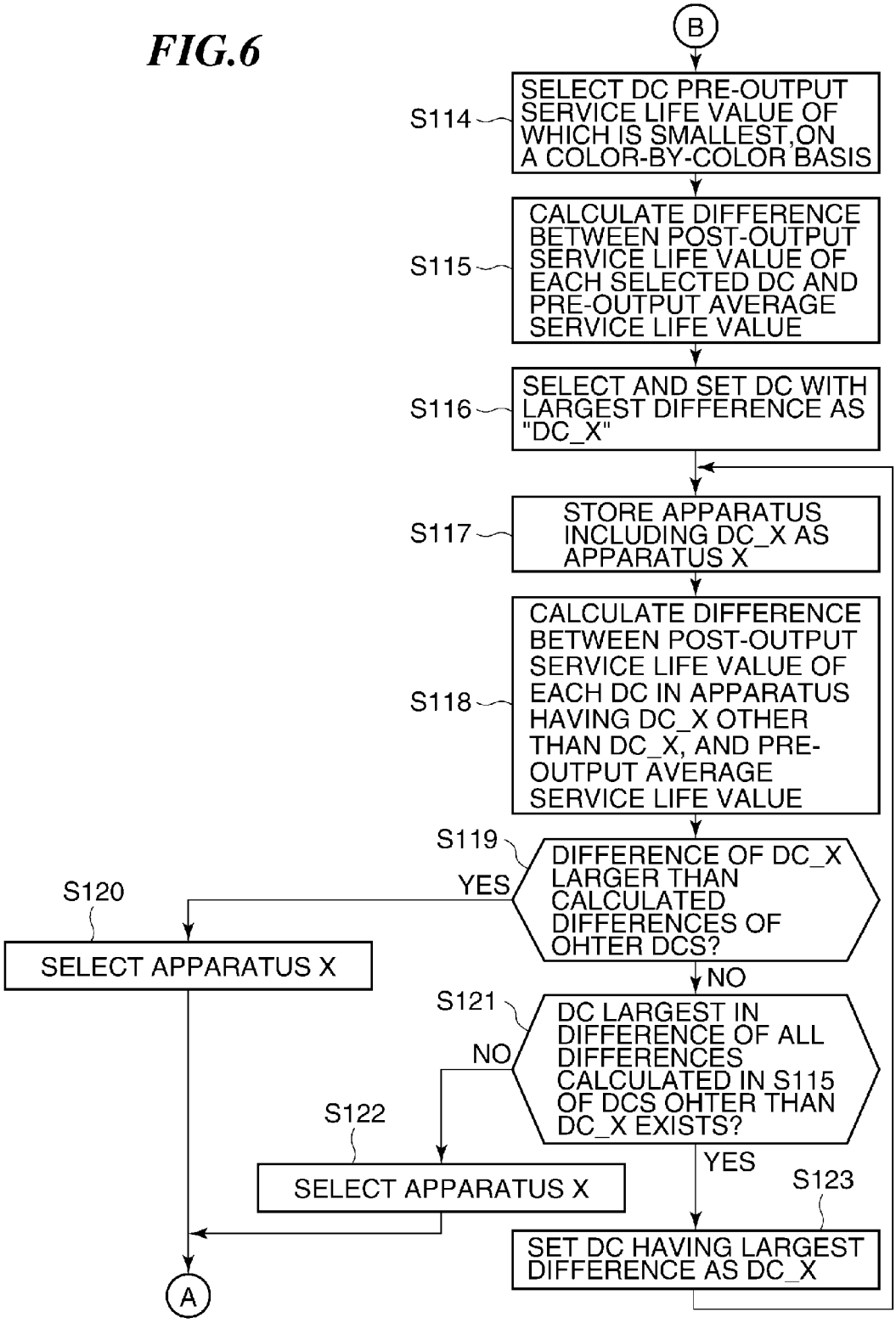
FIG. 6 is a continuation of FIG. 5.

FIGS. 5 and 6 are flowcharts of an apparatus selection process which is executed by the apparatus management server 103 when output of an image is instructed.

In FIGS. 5 and 6, the drum cartridge is simply denoted as "DC".

Referring to FIG. 5, it is determined whether or not output of a monochrome image is instructed (step S101). If it is determined in the step S101 that output of a monochrome image is instructed (YES to the step S101), member information including the total charging time period C and an average image ratio D of a monochrome drum cartridge designated by the storage section 107, is acquired. Then, service life values P of the designated monochrome drum cartridges of all the image forming apparatuses are calculated and acquired (step S102), and one of the image forming apparatuses that includes a monochrome drum cartridge having the smallest service life value L is selected (step S103). Next, the image forming apparatus selected as a recommended output apparatus that is recommended for output of the monochrome image is caused to be displayed on the console sections 109 of the image forming apparatuses 104, 105, and 106 or on the personal computers 101 and 102 (step s112). Then, the monochrome image is output by the image forming apparatus designated by the user (step s113), followed by terminating the present process. As described above, in the present embodiment, it is explicitly indicated using the personal computers 101 and 102 with which the user instructs the apparatus management server 103 or the image forming apparatuses 104, 105, and 106, that the selected image forming apparatus is to output an image.

On the other hand, if it is determined in the step S101 that the image instructed to be output is not a monochrome image (NO to the step S101), service life values before and after image output (pre-output and post-output service life values) of the drum cartridges of all colors of all the image forming apparatuses are calculated, and further an average value of the pre-output service life values (pre-output average service life value) is calculated on a color basis (step S104). Here, it is assumed that there are n apparatuses and the drum cartridges of the respective apparatuses are referred to as Y1, M1, C1, K1 to Yn, Mn, Cn and Kn.

Then, it is determined whether or not all the apparatuses have at least one drum cartridge a service life value of which will reach P2 after output of the image, i.e. a post-output service life value of which reaches P2 (step S105).

If it is determined in the step S105 that all the apparatuses have at least one drum cartridge a post-output service life value of which reaches P2 (YES to the step S105), from each apparatus, a drum cartridge a post-output service life value of which is largest of all the color drum cartridges Y, M, C, and K of the apparatus is selected (step S106).

Then, the selected drum cartridges of the respective apparatuses are compared in respect of the post-output service life value (service life value after output of the image), and an apparatus having a drum cartridge the post-output service life value of which is the smallest of all the selected drum cartridges is selected (step S109). Then, the process proceeds to the above-described step S112. For example, assuming that the drum cartridges Y, M, C, and K of an apparatus A have respective post-output service life values of 54 k, 56 k, 55 k, and 54 k, the drum cartridge M has the largest post-output service life value, and hence the drum cartridge M having a post-output service life value of 56K is selected from the apparatus A. If in an apparatus B, a drum cartridge C has a post-output service life value of 56.5 k and this value is the largest of all the values of the drum cartridges of the apparatus B, the drum cartridge C having a post-output service life value of 56.5 k is selected from the apparatus B. Further, if in an apparatus C, a drum cartridge K has a post-output service life value of 57 k and this value is the largest of all the values of the drum cartridges of the apparatus C, the drum cartridge K is selected from the apparatus C. Thus, the drum cartridges each having the largest service life value in each apparatus are selected. Then, these post-output service life values are compared with each other to determine the smallest one of them, and an apparatus including a drum cartridge having the smallest one of the post-output life service values is selected for use. In the above-described example, the post-output service life value of the cartridge M of the apparatus A is smallest, and hence the apparatus A is selected for use. By thus selecting one of the apparatuses, it is possible to wait for replacement work in a state where an image defect produced by a drum cartridge having a service life value larger than P2 is held at a level as slight as possible.

If the answer to the question of the step S105 is negative (NO to the step S105), it is determined whether or not all the drum cartridges of all the apparatuses have post-output service life values which reach P1 (step S107). If the answer to the question of the step S107 is affirmative (YES to the step S107), from each of apparatuses having no drum cartridge the post-output service life value of which reaches P2, a drum cartridge which is largest in the post-output service life value of all the cartridges of the apparatus is selected (step S108). Then, the process proceeds to the above-described step S109.

By thus executing the selection in the step S108, it is possible to hold the service life values of all the drum cartridges between P1 and P2 without causing the service life values of drum cartridges to reach P2 to the utmost.

If the answer to the question of the step S107 is negative (NO to the step S107), it is determined whether or not the respective post-output service life values of the drum cartridges of all the apparatuses including a drum cartridge having a pre-output service life value smaller than P1 reach P1 (step S110).

If the answer to the question of the step S110 is affirmative (YES to the step S110), first, on an apparatus-by-apparatus basis, there is calculated a difference ΔP between a pre-output service life value smaller than P1 of a drum cartridge the post-output service life value of which does not reach P1 and a pre-output average service life value Pav of the same color drum cartridges of all the apparatuses. Then, an apparatus including a drum cartridge having the largest one of the calculated differences ΔP is selected (step S111), and then the process proceeds to the above-described step S112. Note that pre-output average service life values Pyav., Pmav., Pcav., and Pkav. of the color drum cartridges of respective colors of all the apparatuses are calculated in advance in the step S104.

As described above, out of drum cartridges which are used less frequently and hence have smaller service life values than P1, a drum cartridge is selected which is largest in difference between the pre-output service life value thereof and the pre-output average service life value of the drum cartridges of the same color of all the apparatuses. Then, an apparatus including the selected drum cartridge is caused to be used. This makes it possible to make the respective service life values of the drum cartridges of each same color of all the apparatuses closer to each other. Further, at this time, there is no drum cartridge the post-output service life value of which reaches P2.

Next, if the answer to the question of the step S110 is negative (NO to the step S110), first, a drum cartridge is selected which has a pre-output service life value smallest of all the drum cartridges of each color of all the apparatuses (step S114). In other words, one drum cartridge having the smallest service life value of all the drum cartridges of the same color of the apparatuses is selected for each color.

Then, a difference between the post-output service life value of the selected drum cartridge of each color and the pre-output average service life value of the color is calculated (step S115). The calculated differences are denoted as ΔPyb, ΔPmb, ΔPcb, and ΔPkb.

Then, an apparatus having a drum cartridge which is largest in the difference (denoted as "DC_X") is selected (step S116). Then, the apparatus having DC_X is stored as an apparatus X (step S117).

Next, in the apparatus having DC_X, a difference between the post-output service life value of each drum cartridge other than DC_X and an associated pre-output average service life value is calculated (step S118). More specifically, for example, in the case of DC_X being a drum cartridge Y, respective differences between the post-output service life values of the drum cartridges C, M, and K of the apparatus and respective associated pre-output average service life values are calculated.

Then, it is determined whether or not the difference of DC_X is larger than all of the calculated differences of the drum cartridges C, M, and K (step S119). In the case of the above-described example, assuming that the calculated differences of the drum cartridges C, M, and K are represented by ΔPma, ΔPca, and ΔPka, it is determined whether or not ΔPyb (the difference of the drum cartridge Y)>ΔPma, ΔPca, and ΔPka holds.

If the answer to the question of the step S119 is affirmative (YES to the step S119), the apparatus having DC_X, is selected (step S120), and the process proceeds to the above-described step S112 in FIG. 5.

On the other hand, if the answer to the question of the step S119 is negative (NO to the step S119), it is determined whether or not there is a drum cartridge of a color other than the color of DC_X, which has a difference not larger than the difference of DC_X but largest of the other differences calculated in the step S115 (step S121). That is, in the above-described example, among the drum cartridges of colors other than Y of the apparatus having DC_X, if there is a drum cartridge whose difference between a post-output service life value and a pre-output average service life value of the same color is larger than the difference ΔPyb of the drum cartridge Y, selection of an optimum apparatus is executed again from the other apparatuses.

If the answer to the question of the step S121 is negative (NO to the step S121), the apparatus X stored in the step S117 is selected (step S122), and then the process proceeds to the above-described step 112 in FIG. 5.

On the other hand, if the answer to the question of the step S121 is affirmative (YES to the step S121), a drum cartridge whose difference is smaller than that of DC_X but largest of the other differences calculated in the step S115 is newly set as DC_X (step S123), and then the process returns to the step S117.

Next, a supplementary description will be given of the steps S118 to S123. First, in the step S115, for each of the drum cartridges of respective colors having the smallest service life values, the difference between the post-output service life value of a color and the pre-output average service life value of the same color is calculated. In the present example, since there are four colors of C, M, Y, and K, four differences are calculated. Further, in the steps S116 to S118, processing is performed for the drum cartridge having the largest difference, and hence if the answer to the question of the step S119 is negative, there is a drum cartridge whose difference is smaller than that of DC_X but largest of the differences of the other colors. By newly setting this drum cartridge as the DC_X in the step S123, differences are recalculated in an apparatus having the newly set DC_X in the step S118. Thus, four loops at the maximum are executed until a drum cartridge is found as to which the answer to the question of the step 119 is affirmative. If the answer to the question of the step S119 does not become affirmative even in the fourth loop, the apparatus which was first set as the apparatus X is selected.

Thus, it is possible to preferentially use, out of all the apparatuses, an apparatus having a drum cartridge whose post-output service life value is smaller than the pre-output average service life value of each color, and prevent the service life values of the other-color drum cartridges of the apparatus from largely exceeding the average values thereof.

Further, although in the present embodiment, when a recommended apparatus is selected, the apparatus management server 103 displays the recommended apparatus on the display screens of the personal computers 101 and 102 of users for outputting an image, and guides the user to configure settings according to user's intention, this is not limitative, but a selected apparatus may be forcibly used.

With the above-described configuration, it is possible to replace drum cartridges at the same time when many of the service life values of drum cartridges in a plurality of apparatuses fall within a range between P1 and P2. Note that in the above-described apparatus selection process, the steps S103, S109, S111, S120, and S122 correspond to operations of selection units. As described hereinabove, in the present embodiment, when an image is output, member information is acquired from each of a plurality of image forming apparatuses, and service life information indicative of the wear level of members is acquired using the acquired member information. Then, by using the acquired service life information, an image forming apparatus for outputting an image is selected such that a difference between the wear levels becomes smaller between the plurality of image forming apparatuses. This makes it possible to enhance the efficiency of maintenance work of the image forming apparatuses.

Next, a description will be given of a second embodiment of the present invention. Although in the first embodiment, drum cartridges of a plurality of apparatuses are replaced approximately at the same time, in this case, it occurs that the user waits for maintenance personnel in a state in which drum cartridges in many of the apparatuses have expired at the same time.

To overcome this convenience, in the present embodiment, a plurality of apparatus main units are divided into a group A and a group B such that determinations with reference to the respective target service life values P1 and P2 are differentiated between the two groups.

Specifically, although the target service life values P1 and P2 are set as 47 k and 50 k, respectively, for both the groups, as for the apparatuses of the group B, service life values obtained by adding 25 k to originally calculated service life values are used for comparison with the target service values, for determination.

By doing this, even when an output is instructed which will cause the service life value of a drum cartridge in an apparatus of the group B to exceed 25 k, it is judged that the service life value exceeds 50 k, so that an apparatus of the group A having drum cartridges with service life values smaller than 50 k comes to be preferentially used.

As a consequence, the frequencies of use of the drum cartridges in the apparatuses of the group B once become low when the actual service life values of the drum cartridges are in a range between 22 k and 25 k. This makes it possible to continue using the apparatuses of the group B in timing where replacement of the drum cartridges of the group A is performed.

Next, when the drum cartridges of the group A reach their target service life values and are collected and replaced, the counters of the drum cartridges of the group A are reset to make the service life values of the drum cartridges equal to 0. At the timing, the apparatus management server cancels the mode for adding 25 k to the originally calculated service life values of the drum cartridges in the apparatuses of the group B, and on the other hand, sets the apparatuses of the group A to the mode for adding 25 k to the originally calculated service life values of the drum cartridges.

Since the counters of the drum cartridges of the group B are originally advanced by 25 k, the drum cartridges of the group B reach the service life of 50 k prior to the drum cartridges of the group A, while maintaining approximately equal conditions.

As described heretofore, in the present embodiment, when service life information on part of a plurality of image forming apparatuses becomes service life information indicative of a predetermined wear level, the other image forming apparatuses than the part of the image forming apparatuses are selected as image forming apparatuses for outputting images.

Note that in the present embodiment, when a plurality of image forming apparatuses simultaneously perform operation for forming an image of the same original, it is possible to equally maintain the hues of output images by selecting apparatuses of the same group.

As described heretofore, according to the present invention, a message recommending the user to use an apparatus or a drum cartridge with less usage history than others as much as possible is displayed or such an apparatus or a drum cartridge is forcibly used, whereby it is possible to replace a predetermined number of wear-prone components at the same time.

Further, by adjusting the usage histories of drum cartridges of each apparatus on a color-by-color basis such that they become equal to each other, it is possible to minimize difference in the hues between the apparatuses. Furthermore, the frequencies of use of the apparatuses and drum cartridges are adjusted such that timing of expiration of the service lives of a predetermined number of apparatuses or those of a predetermined number of drum cartridges is positively shifted, whereby it is possible to prevent simultaneous maintenance work from making it impossible to use any of the image forming apparatuses.

As described above, according to the present invention, even when the apparatuses are tandem-type full-color image forming apparatuses, it is possible to perform optimum adjustment of the frequency of use of each apparatus and that of each color unit, enhance efficiency of maintenance work, and at the same time ensure preservation of equal image quality between the apparatuses.

Further, in this case, it is possible to eliminate the inconvenience that simultaneous replacement of the wear-prone components of all the apparatuses temporarily makes it impossible to use any apparatuses. Furthermore, to adjust the frequencies of use of the apparatuses more effectively, it is possible to guide the user to select optimum apparatuses.

Note that it is apparent that as for the apparatus selection process, the service life prediction, and the detection method, described in the embodiments, various substitutions following the ideas of the present invention are possible, and are included in the present invention.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2011-221788 filed Oct. 6, 2011, which is hereby incorporated by reference herein in its entirety.

What is claimed is:

1. A management apparatus that is connected to a plurality of image forming apparatuses, each of which includes a storage unit for storing information indicative of wear levels of members for outputting a color image, on a color-by-color basis, via a network, comprising:

an acquisition unit configured to acquire the information from each of the plurality of image forming apparatuses; and a selection unit configured to select an image forming apparatus for outputting an image, based on the information acquired by said acquisition unit, such that differences between the wear levels become smaller between the plurality of image forming apparatuses, wherein the members are photosensitive drums, and the information is determined according to charging time periods for the photosensitive drums and an average image ratio.

2. The management apparatus according to claim 1, wherein it is explicitly indicated, using a host apparatus with which a user instructs the management apparatus, or the plurality of image forming apparatuses, that the image forming apparatus selected by said selection unit is to output an image.

3. The management apparatus according to claim 1, wherein the information on part of the plurality of image forming apparatuses matches information indicative of a predetermined wear level, said selection unit selects an image forming apparatus other than the part of the plurality of image forming apparatuses, as the image forming apparatus for outputting an image.

4. A management system comprising:

a plurality of image forming apparatuses, each of which includes a storage unit configured to store information indicative of wear levels of members for outputting a color image, on a color-by-color basis; and a management apparatus connected to said plurality of image forming apparatuses via a network, and including:

an acquisition unit configured to acquire the information from each of said plurality of image forming apparatuses, and a selection unit configured to select an image forming apparatus for outputting an image, based on the information acquired by said acquisition unit, such that differences between the wear levels become smaller between said plurality of image forming apparatuses, wherein the members are photosensitive drums, and the information is determined according to charging time periods for the photosensitive drums and an average image ratio.

5. The management system according to claim 4, wherein it is explicitly indicated, using a host apparatus with which a user instructs the management apparatus, or the plurality of image forming apparatuses, that the image forming apparatus selected by said selection unit is to output an image.

6. The management system according to claim 4, wherein the information on part of the plurality of image forming apparatuses matches information indicative of a predetermined wear level, said selection unit selects an image forming apparatus other than the part of said plurality of image forming apparatuses, as the image forming apparatus for outputting an image.

7. A method of controlling a management apparatus that is connected to a plurality of image forming apparatuses, each of which includes a storage unit for storing information indicative of wear levels of members for outputting a color image, on a color-by-color basis, via a network, comprising:

acquiring the information from each of the plurality of image forming apparatuses; and selecting an image forming apparatus for outputting an image, based on the acquired information, such that differences between the wear levels become smaller between the plurality of image forming apparatuses, wherein the members are photosensitive drums, and the information is determined according to charging time periods for the photosensitive drums and an average image ratio.

8. The method according to claim 7, wherein it is explicitly indicated, using a host apparatus with which a user instructs the management apparatus, or the plurality of image forming apparatuses, that the selected image forming apparatus is to output an image.

9. The method according to claim 7, wherein the information on part of the plurality of image forming apparatuses matches information indicative of a predetermined wear level, said selecting includes selecting an image forming apparatus other than the part of the plurality of image forming apparatuses, as the image forming apparatus for outputting an image.

* * * * *